United States Patent [19]

Calder

[11] 4,116,386

[45] Sep. 26, 1978

[54] SPRAY NOZZLE HEAD

[75] Inventor: Oliver J. Calder, Orange, Calif.

[73] Assignee: A.S.M. Company, Orange, Calif.

[21] Appl. No.: 768,334

[22] Filed: Feb. 14, 1977

Related U.S. Application Data

[63] Continuation-in-part of Ser. No. 660,104, Feb. 23, 1976, abandoned.

[51] Int. Cl.[2] ..... B05B 15/02

[52] U.S. Cl. ..... 239/119; 239/288; 285/282

[58] Field of Search ..... 239/119, 288, 288.3, 239/288.5, 390–393, 397, 436, 437, 600, 601, 602; 285/282, DIG. 8

[56] References Cited

U.S. PATENT DOCUMENTS

| | | | |
|---|---|---|---|
| 2,717,141 | 9/1965 | Livingston | 285/282 X |
| 3,202,360 | 8/1965 | O'Brien | 239/119 |
| 3,464,740 | 9/1969 | Scruby et al. | 302/64 |
| 3,528,611 | 9/1970 | Watson | 239/119 |
| 3,593,920 | 7/1971 | Watson | 239/119 |
| 3,952,955 | 4/1976 | Clements | 239/288.5 |
| 3,955,763 | 5/1976 | Pyle et al. | 239/119 |
| 3,963,180 | 6/1976 | Wagner | 239/288.5 |
| 4,025,045 | 5/1977 | Kubiak | 239/288.5 |

*Primary Examiner*—John J. Love
*Assistant Examiner*—Andres Kashnikow
*Attorney, Agent, or Firm*—Fulwider, Patton, Rieber, Lee & Utecht

[57] ABSTRACT

There is disclosed a spray nozzle head for spraying of pressured liquid such as airless spraying and the like which is constructed with a minimal number of parts and which provides for facile reversal of the spray orifice in the head, thereby permitting the orifice to be cleaned by the liquid pressure. The spray nozzle comprises a body with a longitudinal through passageway and a cylindrical through bore orthogonal to and intersecting the through passageway. A cylindrical turret member which carries a removable orifice spray tip is seated in the through bore and is restrained therein by a detent which permits rotation of the turret member through at least 180° for reversing the direction of the orifice spray tip. The turret member is sealed by a single seal washer that is biased against the turret member by an adaptor threaded into an internally threaded counterbore in the longitudinal through passageway of the body. The body is turned to advance the adaptor against the seal washer biasing the latter against the turret member, sealing the latter and permitting discharge of the liquid through the orifice tip. When the orifice tip becomes clogged, the turret member is released for rotation by twisting the body on the adaptor, releasing the tension on the seal washer and permitting the turret member to be rotated 180° by finger pressure. In another embodiment, the necessity for twisting of the body on the adaptor is eliminated by providing a hand lever on the turret member whereby the turret member can be rotated against the biasing force of the adaptor.

15 Claims, 7 Drawing Figures

FIG. 1
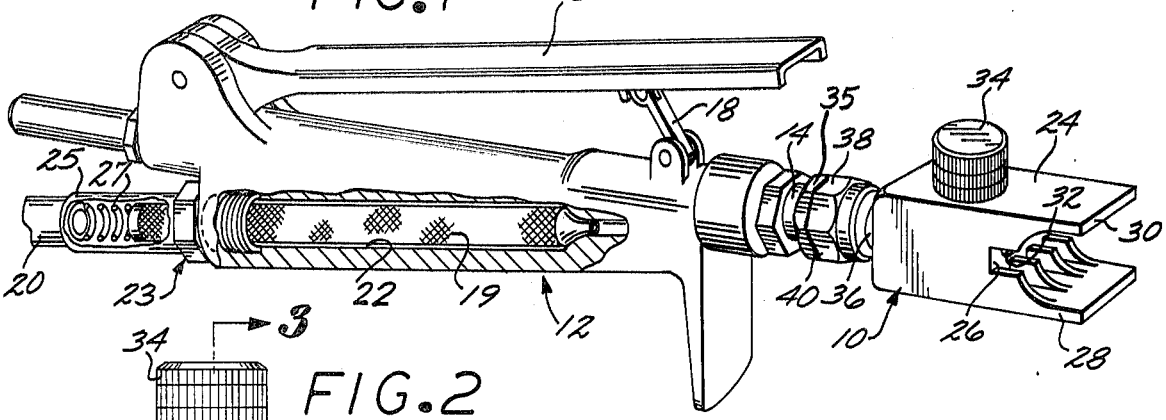
FIG. 2
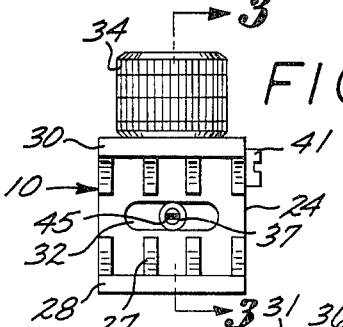
FIG. 3
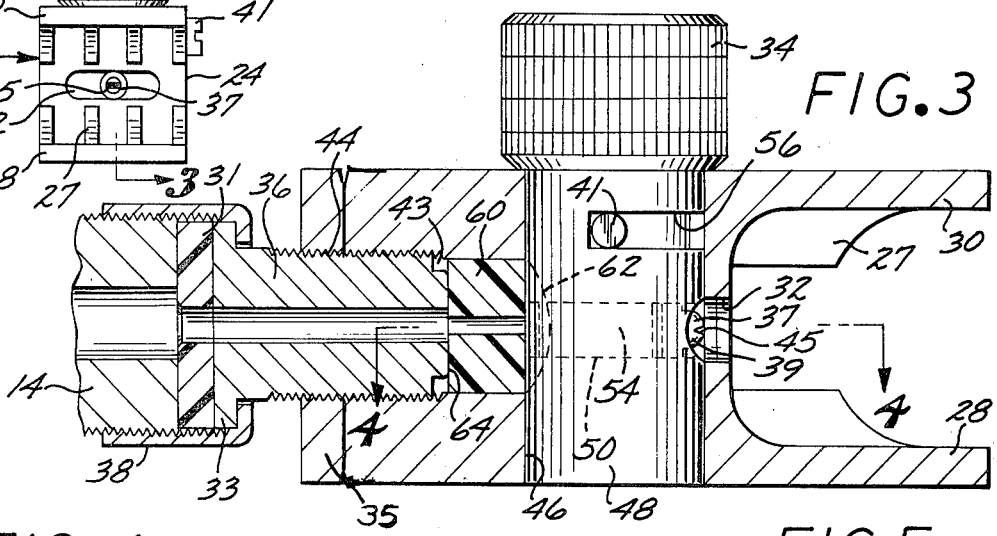
FIG. 4
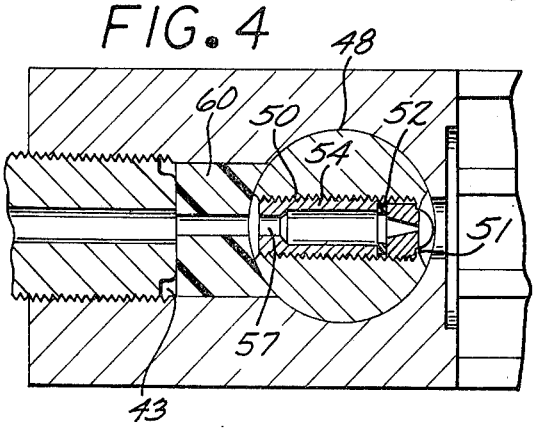
FIG. 5
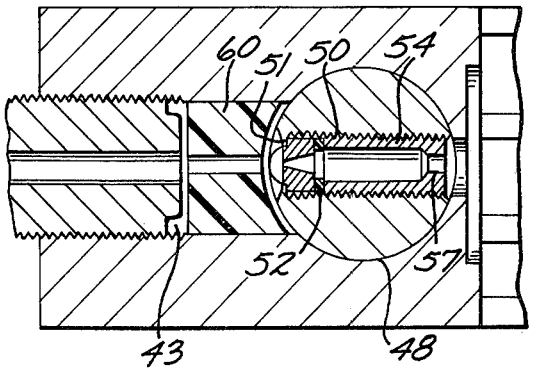
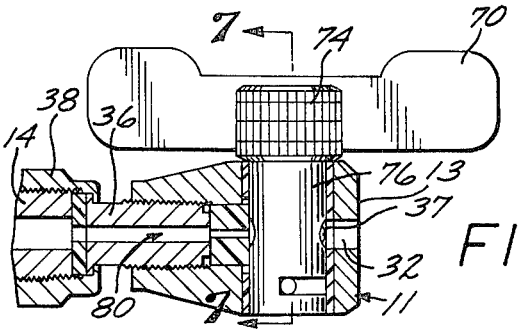
FIG. 6
FIG. 7
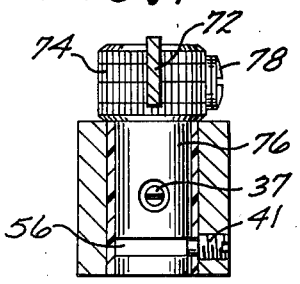

SPRAY NOZZLE HEAD

REFERENCE TO RELATED APPLICATIONS

This application is a continuation-in-part of my parent application, U.S. Ser. No. 660,104, filed on Feb. 23, 1976, now abandoned.

BACKGROUND OF THE INVENTION

1. Field of the Invention

This invention relates to a liquid spray nozzle and, in particular, to a spray nozzle having a reversible spray tip ideally suited for airless spraying.

2. Brief Description of the Prior Art

Airless spraying is finding increasing acceptance in the industry because precise spray patterns can be achieved by this system. Airless spraying requires the use of a very minute and precisely shaped orifice spray member which, typically, is formed of tungsten carbide. The orifice spray member has a through passageway with a convex discharge face but having a V-groove which intersects the through passageway, thereby providing a flat spray pattern.

A common difficulty experienced in airless spraying is that minute solids such as impurities and precipitates in the liquid become clogged in the orifice, necessitating its cleaning. A number of approaches have been developed to reverse the orifice tip member in the assembly whereby the liquid pressure can be applied to dislodge the solids from the passageway. Generally, however, the nozzle heads which permit reversal of the orifice tip member are relatively complex with a substantial number of parts, adding to the cost of assembling and increasing the probability of failure in use. Various constructions which have been employed for reversal of the spray tip member have included a housing that rotatably supports a spherical turret between opposite annular seals. The orifice tip member is removably mounted in the turret member. Other embodiments have included mounting of the turret member in a cylindrical turret that is received in a body having a large diameter spray discharge opening whereby the orifice tip member can be removed from the turret member through the spray opening in the front of the nozzle without removing the nozzle from the supporting barrel of a spray gun and the like.

Other approaches for the reversing of the orifice spray tip member have included mounting the spray tip member on a slide that can be removed and reversed in its assembly with the housing.

Generally, the aforementioned attempts for reversibility of an orifice tip member have required relatively complex and costly construction. It is, therefore, desirable to provide a relatively inexpensive unit which provides for facile reversal of the orifice tip member in the spray nozzle.

BRIEF STATEMENT OF THE INVENTION

This invention comprises a nozzle for airless spraying of liquids and the like which comprises a body having a longitudinal through passageway, an internally threaded counterbore therein, a cylindrical through bore orthogonal to the longitudinal through passageway and a cylindrical turret member seated in the cylindrical through bore and bearing a second through passageway which is generally coaxial with the first through passageway of the body. Detent means, to restrain the turret member in the cylindrical through bore, is mounted in the body, a spray orifice tip member is seated in the second through passageway of the turret member, seal means is provided in the longitudinal through passageway of the body upstream of the turret member and an adaptor means is removably seated in the threaded counterbore with its front face bearing against the seal means, biasing the seal means in a sealing relationship to the turret member.

In another embodiment of the invention, the turret member is provided with lever means exterior of the body to facilitate rotation of the turret member, reversing the spray tip member and eliminating the necessity to relieve the pressure of the adaptor against the seal means, otherwise necessary for facile reversal of the spray tip member.

BRIEF DESCRIPTION OF THE DRAWINGS

The invention will be described with reference to the illustrated and presently preferred embodiment of the invention of which:

FIG. 1 illustrates a spray gun fitted with a spray nozzle of the invention;

FIG. 2 is a view of the front of the spray nozzle shown in FIG. 1;

FIG. 3 is a side elevation view of the spray nozzle along lines 3—3 of FIG. 2;

FIG. 4 is a sectional view of the spray nozzle along lines 4—4 of FIG. 3;

FIG. 5 is a partial sectional view similar to FIG. 4 showing the spray tip member and turret in its reversed cleaning position; and FIGS. 6 and 7 show an alternate embodiment of the invention.

Referring now to FIG. 1, the invention is generally indicated by a spray nozzle 10 that is removably attached to a spraying member such as a spray gun 12. The illustrated spray gun has a barrel 14 for discharge of pressured liquid therefrom in response to movement of an internal valve mechanism controlled by handle 16. Suitable lock means such as link 18 are included on the housing of the valve 12 to lock the handle 16 in a closed valve position whereby the pressured liquid cannot be accidentally discharged. The link 18 is pivotally mounted on the gun 12 for forward movement to release the lock and permit one to pivot handle 16 to open the spray gun valve. The pressured liquid is supplied through a conduit 20 which communicates into a filter compartment 22 through a filter retainer 23 which has a sleeve body 25 that receives spring 27 to bias the filter 19 forward in compartment 22. Retainer 23 has an externally threaded end which is received in gun 12. Cylindrical filter 19 is of sufficient length to project out of gun 12 and into retainer 25 an adequate distance that the removal of retainer 25 will expose a length of filter from 0.25 to about 1 inch adequate to be grasped by one's fingers or a tool, thereby facilitating removal of the filter.

The nozzle of the invention has a body 24 with a front face 26 from which projects a pair of generally parallel, flat guard blades 28 and 30. These blades provide a safety feature by serving as protective shields to obstruct entry of a finger or limb into the spray pattern as it is discharged from the elongated orifice 32 in the face 26 of body 24. The front face is also provided with a plurality of ribs 27 which are orthogonal to blades 28 and 30. These ribs are spaced apart sufficiently to avoid interference with the spray pattern and yet obstruct the interior space between blades 28 and 30 sufficiently to prevent one from placing a finger against or near the discharge orifice 32.

Body 24 also rotatably supports a turret member which has a lever means in the form of knob 34 projecting from one side thereof. The body 24 is carried in the assembly on an adaptor 36 which is secured to the discharge face of barrel 14 by a threaded retainer nut 38 which has wrench flats 40 for tightening of the adaptor to the spray gun 12 at any desired angular orientation thereto and lock nut 35 to secure the adaptor.

The front of the spray nozzle 10 is illustrated in FIG. 2. The slot 32 in the face 26 of body 24 is generally elongated and is parallel to the spaced-apart, parallel guard wings 28 and 30. Behind the slot 32 is the front of an orifice tip member 37 which has a generally hemispherical front face 39 and which bears a transverse, V-groove 45 that intersects an internal passageway through the orifice tip member. Two opposed sets, each with four equally spaced ribs 27, line the interior space between guard blades 28 and 30.

The turret member is rotatably mounted within a cylindrical through bore in housing 10 and has knob 34 projecting from one side thereof for grasping by an operator and for rotating the turret member. Suitable detent means are provided to restrain the turret member within its bore of body 24. The detent means can be seen to comprise a conventional machine screw 41 that extends from one side of body 24, projecting into the bore therein and into a slot cut into the turret member in a manner described in greater detail with reference to FIG. 3.

Referring now to FIG. 3, the invention is shown in partial cross section. The body 24 has a longitudinal through passageway 43 which is provided with internal threads 44. The through passageway discharges as the slot 32. The dimensions of slot 32 are provided sufficient to avoid any interference with the spray pattern developed from the orifice tip member 37. The body also bears a cylindrical through bore 46 which is orthogonal to, and which intersects with, the longitudinal through passageway 43. The turret member 48 seats within the through passageway 46 and carries knob 34 at one end thereof. The turret member also bears a central through passageway 50 in which is seated, at its forward end, the orifice spray tip member 37. This member is sealed in the through passageway 50 by seal means 52 which can be a conventional shaped washer formed of a suitable plastic such as polypropylene, Nylon, Delrin, etc. The washer is forced against the rear face of the orifice tip member 37 by the lock nut 54 which can comprise a conventional externally threaded set screw having a through passageway. The spray tip member 37 is retained in passageway 50 by peripheral shoulder 51.

The turret member also bears detent means restraining the turret member within the through bore 46. This is illustrated by the slot 56 which extends about the periphery of the turret member for at least 180°. Slot 56 receives the inboard end of machine screw 41 that serves as a stop means cooperative with the slot to limit the freedom of rotation of the turret member, thereby insuring that, at the extreme travel in either direction of the turret member, the orifice spray tip member 37 and through passageway 50 are coaxial with the through passageway 43.

The turret member is sealed in the assembly by seal ring 60 which has an arcuate concave interior face 62 that bears against the side of turret member 48. Adaptor 36 is threaded in internal threads 44 and has its forward face bearing against the rear face 64 of seal ring 60, thereby biasing the arcuate face 62 of seal ring 60 against the side of the circular turret member 48. The rear face of adaptor 36 bears a peripheral flange 33 which is received within the retainer nut 38 and which bears against a seal 31 that is formed of a suitable plastic material such as nylon, Deldrin, polyethylene, etc., to permit ease of rotation of the adaptor rear face relative to the front face of barrel 14 of the spray means.

The reversibility of turret member 48 and its associated orifice tip member 37 is illustrated in the sectional views of FIGS. 4 and 5. As illustrated in FIG. 4, the orifice tip member 37 is directed to discharge a spray through the elongated slot 32 of body 24 and the alignment of the generally flat spray member is coplanar with the major dimensions of elongated slot 32. In the sectional view, the seal means 52 with the associated lock nut member 54 is illustrated and it can be seen that the longitudinal passageway 50 through the turret member 48 is generally coaxial with the londitudinal passageway 43 of body 24. When it is desired to reverse the position of the orifice tip member in the assembly, as typically required for dislodging clogged sediment in the orifice tip member, the body 24 is rotated slightly, e.g., from ¼ to ½ turn, to release the compression of the face of adaptor 36 against seal ring 60, freeing turret member 48 for rotation.

The turret member can thus be rotated 180° to the position shown in FIG. 5 reversing the position of orifice tip member 37 in the assembly so the orifice tip member is opposed to the discharge of the longitudinal passageway 43. The body 24 can, thereafter, be rotated back to its previous position where the forward end of the adaptor 36 biases ring 60 against the arcuate surface of turret 48, sealing the assembly. The application of the liquid pressure through the longitudinal passageway 40 can then be directed through the orifice of the orifice tip member 37 dislodging any obstruction therein and discharging the obstructions through the opposite end of the passageway of turret 48. Thereafter, the turret member can be rotated by loosening body member 24 on adaptor 36, rotating the turret member until it reaches its stop as limited by screw 36 which cooperates with the 180° arcuate slot 56 to restore the spraying position shown in FIG. 4. The through passageway in lock nut 54 is, preferably, counterbored at 55 to provide a short exit orifice 57 when the turret member is reversed for cleaning, as shown in FIG. 5. The orifice 57 disrupts the flow and insures that the liquid spray diffuses and breaks up as it exits the gun rather than exiting as a coherent stream that could injure a workman.

Exit orifice 57 should be sized relative to the orifice spray tip of spray tip member 37 for proper operation. If the exit orifice 57 is too small relative to the orifice of the spray tip member 37 or if the orifice is too long the liquid discharged from orifice 57 is formed into a liquid jet, whereas if the orifice 57 is too large, or too short, it causes the liquid to disperse too widely, coating guard blades 28 and 30. Typically, the diameter of the orifice 57 should be from about 5 to about 8 times the diameter of the orifice of the spray tip member. The length of the orifice 57 should be from 0.050 to about 0.2 inch for most airless spray equipment that typically employs spray tip members with orifices from 0.005 to about 0.025 inch diameters in four size classifications.

Referring now to FIGS. 6 and 7, another embodiment of the invention is illustrated. In this embodiment, the body 11 of the nozzle has a generally flat face 13 with an elongated slot 32 for discharge of the spray from the spray tip 37. The body 11 of the nozzle is otherwise similar in design and configuration to body 10 of the nozzle previously described and is fitted on an adaptor 36, also similar to that previously described. The embodiments of FIGS. 6 and 7 differ from that previously described in the lever means generally shown as the flat blade 70 that is fitted in a slot 72 of knob 74 which extends from the turret member 76. The blade 70 is secured in the assembly by suitable means such as machine screw 78 that extends into a threaded bore intersecting the slot 72. The embodiment shown in FIGS. 6 and 7 is also slightly modified in the location of the detent means, slot 56 and screw 41 distally from the knob 74. Because of the lever advantage secured by blade 70, the turret member 76 with the spray tip member 37 can be reversed in its orientation in the flow passageway, generally indicated at 80, without the necessity to loosen retainer nut 38 on the barrel 14 of the spray gun.

The invention has been described with reference to the illustrated and presently preferred embodiment thereof. It is not intended that the invention be unduly limited by this specific disclosure. Instead, it is intended that the invention be defined by the means, and their obvious equivalent set forth in the following claims.

What is claimed is:

1. A spray tip holder member for rotatable mounting in a nozzle for airless spraying and the like comprising a turret body having an axis of rotation and a central through passageway orthogonal to said axis of rotation;

an orifice tip member received in said central through passageway and secured at one end thereof and having a small diameter orifice to produce a discharge spray pattern; and a second orifice member also received in said central through passageway and secured therein to position a second orifice at the opposite end of the said central through passageway with said central through passageway open between said orifice tip and second orifice members to provide an unimpeded path for liquid therebetween, said second orifice having a diameter effective to diffuse liquid discharged therefrom, preventing its discharge as a coherent stream.

2. The holder member of claim 1 wherein said second orifice member is a retainer sleeve having an externally threaded body received in mating threads of said central through passageway and having a large diameter counterbore to provide said orifice.

3. The holder member of claim 1 wherein said central through passageway has an annular shoulder at said one end to secure said orifice tip member.

4. The holder member of claim 3 wherein said second orifice member biases said spray tip orifice member against said annular shoulder.

5. The holder member of claim 3 including seal means between said spray tip orifice and second orifice members.

6. The holder member of claim 1 wherein said second orifice member has an orifice diameter from about 5 to about 8 times the diameter of the orifice of said orifice tip member.

7. A spray nozzle comprising a nozzle body having a longitudinal through passageway and the holder member of claim 1 wherein said turret body is cylindrical and seated in a cylindrical bore in said nozzle body orthogonal to and intersecting said longitudinal through passageway.

8. The nozzle of claim 7 including detent means restraining said turret member in said cylindrical through bore which comprises a circumferential groove extending partially about said body and pin means mounted in said body and received in said groove.

9. The nozzle of claim 8 also including seal means in said longitudinal through passageway of said body upstream of said turret member; and adaptor means removably seated in said threaded counterbore and bearing against said seal means to bias said seal means in sealing relationship against said turret member when said body is rotated therein.

10. The nozzle of claim 8 wherein said pin means comprises a set screw threadably seated in a bore in said body.

11. The nozzle of claim 8 wherein said body bears an integral spray guard formed by a pair of parallel wing members projecting forward from the forward face of said body.

12. The nozzle of claim 11 also including a plurality of spaced-apart ribs, orthogonal to said wing members and extending therefrom into said spray chamber, terminating therein short of the path of the flat pattern spray discharged from said orifice member.

13. The nozzle of claim 2 including lock nut retainer means cooperative with said adaptor means to secure said nozzle to the discharge barrel of a spray gun.

14. The nozzle of claim 13 including seal washer means between said discharge barrel and the face of said adaptor means permitting said nozzle to be rotated to a desired spraying position.

15. The nozzle of claim 7 wherein said second orifice member has an orifice diameter from about 5 to about 8 times the diameter of the orifice of said orifice tip member.

* * * * *

UNITED STATES PATENT OFFICE

CERTIFICATE OF CORRECTION

Patent No. 4,116,386 Dated September 26, 1978

Inventor(s) Oliver J. Calder

It is certified that error appears in the above-identified patent and that said Letters Patent are hereby corrected as shown below:

Claim 13, line 1, change "2" to --9--.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*